US008263196B2

(12) United States Patent
Moffatt et al.

(10) Patent No.: US 8,263,196 B2
(45) Date of Patent: Sep. 11, 2012

(54) PROTECTION OF PRINTED IMAGES FROM GASFADE

(75) Inventors: John R Moffatt, Corvallis, OR (US); Matthew Thornberry, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1419 days.

(21) Appl. No.: 10/672,486

(22) Filed: Sep. 25, 2003

(65) Prior Publication Data

US 2005/0069684 A1 Mar. 31, 2005

(51) Int. Cl.
*B41M 5/00* (2006.01)

(52) U.S. Cl. ..... 428/32.16; 428/32.17; 428/32.21; 428/704; 347/105; 427/243

(58) Field of Classification Search ..... 428/32.16, 428/32.17, 32.21, 704; 347/105; 427/243
See application file for complete search history.

(56) References Cited

U.S. PATENT DOCUMENTS

| | | | | |
|---|---|---|---|---|
| 3,988,292 | A * | 10/1976 | Moriga et al. | 106/170.1 |
| 4,145,326 | A | 3/1979 | Blackwell | |
| 4,532,015 | A | 7/1985 | Boultinghouse et al. | |
| 4,711,796 | A | 12/1987 | Yu et al. | |
| 4,977,136 | A | 12/1990 | Fujiwara et al. | |
| 5,330,824 | A | 7/1994 | Takimoto et al. | |
| 5,339,146 | A | 8/1994 | Aslam et al. | |
| 5,401,306 | A | 3/1995 | Schmid et al. | |
| 5,423,911 | A | 6/1995 | Coutelle et al. | |
| 5,593,594 | A | 1/1997 | Strutz et al. | |
| 5,837,036 | A * | 11/1998 | Schleicher et al. | 95/138 |
| 5,904,738 | A * | 5/1999 | Purcell | 8/442 |
| 5,948,150 | A * | 9/1999 | Lin et al. | 106/31.13 |
| 6,217,687 | B1 | 4/2001 | Shibata et al. | |
| 6,410,199 | B1 | 6/2002 | Ikeuchi et al. | |
| 6,852,378 | B2 * | 2/2005 | Tsuchida et al. | 428/32.24 |
| 2001/0031341 | A1 | 10/2001 | Kronzer et al. | |
| 2002/0071941 | A1 * | 6/2002 | Tsuchida et al. | 428/195 |
| 2003/0035038 | A1 | 2/2003 | Nakajima | |
| 2005/0020729 | A1 * | 1/2005 | Renz et al. | 523/160 |

FOREIGN PATENT DOCUMENTS

| | | | |
|---|---|---|---|
| EP | 1 024 020 | A | 8/2000 |
| EP | 1 024 020 | A1 | 8/2000 |
| EP | 1138509 | A2 | 10/2001 |
| EP | 1 459 901 | A2 * | 9/2004 |
| JP | 2001-138632 | | 5/2001 |
| JP | 2001-260519 | | 9/2001 |
| JP | 2002-036717 | | 2/2002 |
| JP | 2002-096546 | | 4/2002 |
| JP | 2002-219857 | | 8/2002 |
| JP | 2004-299373 | | 10/2004 |

OTHER PUBLICATIONS

Merriam-Webster OnLine. Coat Definition.*

Oakland, M., et al., Ozone Concentration Effects on the Dark Fade of Inkjet Photographic Prints, NIP17: International Conference on Digital Printing Technologies, pp. 175-178.

Onishi, H., et al., Image Permanence of Ink Jet Photographic Prints, NIP17: International Conference on Digital Printing Technologies, pp. 192-196.

Steiger, R., et al., Light Stability and Gas Fading on Nanoporous Ink-Jet Materials, NIP17: International Conference on Digital Printing Technologies, pp. 222-225.

Niemoller, A., et al., Durability of Ink Jet Transfer Prints Based on Fusible Coatings, NIP17: International Conference on Digital Printing Technologies, pp. 250-253.

Calogirou, A., et al., Decomposition of Terpenes by Ozone During Sampling on Tenax, Anal. Chem., vol. 68, No. 9, May 1, 1996, pp. 1499-1506.

Oakland, M., et al., Ozone Concentration Effects on the Dark Fade of Inkjet Photographic Prints, NIP17: International Conference on Digital Printing Technologies, pp. 175-178, Sep. 2001.

Onishi, H., et al., Image Permanence of Ink Jet Photographic Prints, NIP17: International Conference on Digital Printing Technologies, pp. 192-196, Sep. 2001.

Steiger, R., et al., Light Stability and Gas Fading on Nanoporous Ink-Jet Materials, NIP17: International Conference on Digital Printing Technologies, pp. 222-225, Sep. 2001.

Niemoller, A., et al., Durability of Ink Jet Transfer Prints Based on Fusible Coatings, NIP17: International Conference on Digital Printing Technologies, pp. 250-253, Sep. 2001.

Fick, J., et al., Ozone Removal in the Sampling of Parts per Billion Levels of Terpenoid Compounds: An Evaluation of Different Scrubber Materials, Environ. Sci. Technol., vol. 35, No. 7, 2001, pp. 1458-1462.

* cited by examiner

*Primary Examiner* — Betelhem Shewareged

(57) ABSTRACT

A print medium having increased resistance to gasfade. An inhibitor comprising a sulfur-containing polymer is incorporated into the print medium. The sulfur-containing polymer is poly(1,4-phenylene sulfide) or poly(1,3-phenylene sulfide). The inhibitor is present in at least a surface of the print medium and may be present in the print medium in a concentration from approximately 0.25% by weight per $cm^2$ of the print medium to approximately 30% by weight per $cm^2$ of the print medium. A method of forming the print medium is disclosed as is a method of producing a printed image having increased resistance to gasfade.

16 Claims, 1 Drawing Sheet

PROTECTION OF PRINTED IMAGES FROM GASFADE

FIELD OF THE INVENTION

The present invention relates to a print medium having increased resistance to gasfade. More specifically, the present invention relates to a print medium that includes an inhibitor of atmospheric pollutants.

BACKGROUND OF THE INVENTION

Inkjet inks typically include a colorant, such as a pigment or a dye, in an ink vehicle. When applied to a print medium, the colorant is absorbed into the print medium and produces a printed image. Ideally, once printed, the printed image is permanent and does not fade or degrade over time. However, in actuality, the printed image tends to fade upon exposure to gases or pollutants. This phenomenon is referred to herein as "gasfade" and is also commonly referred to as "airfade." The printed image fades due to atmospheric pollutants, which degrade or decompose the colorants. These atmospheric pollutants include oxygen ("$O_2$"), ozone ("$O_3$"), sulfur dioxide ("$SO_2$"), and nitrogen oxides ("$NO_x$"), such as nitric oxide ("NO"), nitrogen dioxide ("$NO_2$"), nitrogen trioxide ("$NO_3$"), and mixtures thereof. Since many of these atmospheric pollutants are present in air, the printed image will fade even when stored under optimal conditions, such as in a museum or in another controlled environment. $O_3$ is present in ambient air, such as inside homes, offices, or other buildings, at 40-150 parts per billion by volume ("ppbv"), depending on the location, season, weather, and time of day.

The colorant fades due to photodegradation mechanisms, which include oxidation or reduction of the colorant, electron ejection from the colorant, reaction with ground-state or excited singlet state oxygen, and electron or hydrogen atom abstraction to form radical intermediates. The atmospheric pollutants generate free radicals that degrade the inkjet ink and/or the print medium and generate more free radicals, which further accelerate the degradation process.

While gasfade is observed in images printed with either dye-based or pigment-based inkjet inks, it is more pronounced with dye-based inkjet inks. Furthermore, while gasfade is observed on different types of print media, it is especially pronounced when the image is printed on a porous print medium. Porous print media are known in the art and typically include an ink-receiving layer that is formed from porous, inorganic particles bound with a polymer binder. The inkjet ink is absorbed into the pores of the inorganic particles and the colorant is deposited on the surface of the inorganic particles. Porous print media have a short dry time and good resistance to smearing because the inkjet ink is easily absorbed into the ink-receiving layer. However, due to their porous nature, porous print media do not exhibit good resistance to gasfade. Gasfade is less pronounced on swellable print media, which have synthetic or natural polymers that swell when contacted with the inkjet ink. Swelling of the polymer encapsulates the colorant in a coating, which protects the colorant, to a certain extent, from atmospheric pollutants.

Gasfade in porous print media has only recently been identified as a significant problem and, therefore, few solutions to this problem have been proposed. One proposed solution is to add metal oxides to the print media. Alternatively, low molecular weight hindered amine light sensitizers ("HALS"), antioxidants, and UV absorbers are added to the print media. However, these additives are sacrificial and do not provide long term protection. Another proposed solution includes forming a barrier layer over the printed image using lamination techniques. While the barrier layer effectively reduces gasfade, the barrier layer is time consuming to apply and cost intensive.

Some atmospheric pollutants, such as $NO_x$ and $O_3$, are known to react with sulfide functional groups. For instance, $NO_x$ and $O_3$ react with sulfides as shown in the reaction scheme below:

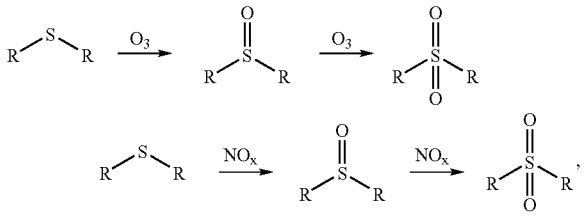

where R is an alkyl group, an aryl group, or a polymer. The $O_3$ or $NO_x$ oxidize the sulfide groups to sultone groups, sulfone groups, or sulfonate groups. The sulfonate group is then converted to sulfonic acid.

Sulfur-containing compounds have been used to filter or remove ozone from gases. For instance, poly(1,4-phenylene sulfide), sodium sulfite, or sodium thiosulfate have been used to remove ozone from air samples containing reactive volatile organic compounds. Non-sulfur containing compounds, such as potassium iodide, potassium carbonate, and manganese dioxide-coated copper have also been used. Poly(phenylene sulfide) ("PPS") has also been used as a filter material to selectively remove ozone from gas samples that contain ozone and organic substances. In addition, PPS has been used to remove ozone from liquid samples. To remove the ozone, the gas or liquid samples are passed through a solid or crystalline form of the sulfur-containing compounds. Alternatively, the gas or liquid samples are passed through a substrate impregnated with the sulfur-containing compounds.

It would be advantageous to reduce gasfade on print media, such as porous print media. In addition, it would be advantageous to provide long term protection against gasfade.

BRIEF SUMMARY OF THE INVENTION

The present invention relates to a print medium having increased resistance to gasfade. The print medium comprises an inhibitor comprising a sulfur-containing polymer, such as poly(1,4-phenylene sulfide) or poly(1,3-phenylene sulfide). The inhibitor has a melting point ranging from approximately 125° C. to approximately 400° C. and a glass transition temperature ranging from approximately 75° C. to approximately 250° C. The inhibitor may be incorporated into at least a surface of the print medium and may be present in the print medium from approximately 0.25% by weight per $cm^2$ of the print medium to approximately 30% by weight per $cm^2$ of the print medium.

The present invention also relates to a method of forming a print medium having increased resistance to gasfade. The method comprises providing a print medium, such as a plain paper, a porous print medium, or a swellable print medium. An inhibitor comprising a sulfur-containing polymer is incorporated into the print medium. The inhibitor may be poly(1,4-phenylene sulfide) or poly(1,3-phenylene sulfide). The inhibitor is heated to a temperature above its melting point and applied to a surface of the print medium. The inhibitor may be present in the print medium from approximately 0.25% by weight per $cm^2$ of the print medium to approximately 30% by weight per $cm^2$ of the print medium.

The present invention also relates to a method of producing a printed image having increased resistance to gasfade. The method comprises depositing inkjet ink onto a print medium, such as a plain paper, a porous print medium, or a swellable print medium. The inkjet ink may be a dye-based or a pigment-based inkjet ink. An inhibitor comprising a sulfur-containing polymer is incorporated into the print medium. The inhibitor may be poly(1,4-phenylene sulfide) or poly(1,3-phenylene sulfide). The inkjet ink may be undercoated or overcoated on the print medium relative to the inhibitor.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1:
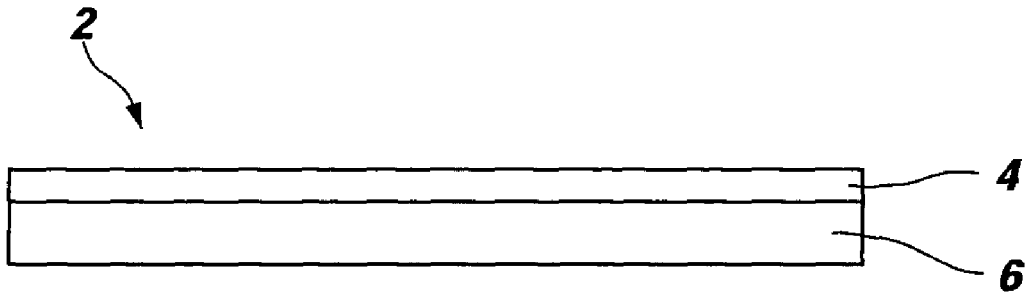
FIGS. 1 and 2 schematically illustrate a print medium of the present invention.

A print medium having increased resistance to gasfade is disclosed. The print medium may include an inhibitor that reacts with at least one atmospheric pollutant, such as $O_2$, $O_3$, $NO_x$, $SO_2$, and other pollutants. By reacting with the inhibitor, the atmospheric pollutant may be prevented from reacting with, and degrading, a colorant of an inkjet ink deposited on the print medium. In addition, the amount of atmospheric pollutant that is available to react with the colorant may be reduced, which reduces fading of an image printed on the print medium. The inhibitor may be used to protect images printed with either dye-based or pigment-based inkjet inks. Because images printed with dye-based inkjet inks tend to be more susceptible to degradation by atmospheric pollutants compared to those printed with pigment-based inkjet inks, the print medium of the present invention may be particularly useful when used with dye-based inkjet inks.

The inhibitor may be selected so that the atmospheric pollutant has a higher reactivity towards the inhibitor than towards the colorant. In other words, the inhibitor reacts preferentially with the atmospheric pollutant over the colorant. The inhibitor may be a compound having at least one functional group that reacts with the atmospheric pollutant. The functional group may include, but is not limited to, a thiol group, a sulfide group, and a disulfide group. The inhibitor may be a sulfur-containing polymer, such as a polyarylene thioether formed from monomers having the formula —[Ar—S]—, where Ar is an arylene group. The arylene group may be a 5- or 6-membered ring having one or more heteroatoms, such as nitrogen or oxygen. The arylene group may be unsubstituted or substituted, such as with linear or branched alkyl groups, halogen groups, hydroxyl groups, amino groups, nitro groups, cyano groups, or carboxyl groups. It is also contemplated that the polyarylene thioether may include different types of arylene groups. For instance, the polyarylene thioether may be formed from arylene thioether monomers having the formula —[$Ar^1$—S]—[$Ar^2$—S]—, where $Ar^1$ and $Ar^2$ are different arylene groups. The inhibitor may also be a sulfur-containing polymer having an alkyl group, such as a polyalkyl thioether or a polyalkylene thioether. After reacting with the atmospheric pollutant, a fully or partially oxidized species of the inhibitor is formed.

In order to incorporate the inhibitor into the print medium, the inhibitor may have a melting point from approximately 125° C. to approximately 400° C. and a glass transition temperature ("$T_g$") from approximately 75° C. to approximately 250° C. However, it is also contemplated that inhibitors that are liquids at ambient temperature may be used.

The print medium may include a sufficient amount of the inhibitor to remove the atmospheric pollutants that contact the print medium. The inhibitor may be present on the print medium in a concentration from approximately 0.25% by weight per $cm^2$ of the print medium to approximately 30% by weight per $cm^2$ of the print medium. Desirably, the inhibitor may be present from approximately 1% by weight per $cm^2$ of the print medium to approximately 20% by weight per $cm^2$ of the print medium. More desirably, the inhibitor may be present from approximately 1% by weight per $cm^2$ of the print medium to approximately 10% by weight per $cm^2$ of the print medium. The inhibitor may have a sufficient number of functional groups to react with the atmospheric pollutants that are in contact with the print medium. In other words, an excess of functional groups may be present in the print medium relative to the amount of atmospheric pollutant that is present in the ambient air.

Since each functional group may sacrificially react with up to three moles of the atmospheric pollutant, such as when the sulfide group is fully oxidized to the sulfonate group, the inhibitor may include a sufficient number of functional groups to provide long term protection against gasfade. In other words, the inhibitor may include a sufficient number of functional groups so that functional groups are available to react with the atmospheric pollutants over an extended period of time. As such, the functional groups may be present in the print medium in an excess amount relative to the amount of atmospheric pollutant that is present in ambient air. To obtain a sufficient number of functional groups to provide long term protection, the inhibitor may be a polymer formed from a large number of monomers. Desirably, each monomer has at least one functional group that is capable of reacting with the atmospheric pollutant. Since a polymer having a high molecular weight typically has a larger number of functional groups than a polymer having a lower molecular weight, it is desirable that the inhibitor has a high molecular weight, such as a molecular weight over approximately 1000. Desirably, the inhibitor has a molecular weight over approximately 10000.

To form the print medium 2 of the present invention, the inhibitor 4 may be present on at least a surface, such as the upper surface, of the print medium 2, as shown in FIG. 1. As explained in detail below, the print medium 2 may be a plain paper 6 or a specialized photographic medium. Depending on the inhibitor's penetration into the print medium 2, the inhibitor 4 may also be present on additional portions of the print medium 2. While FIG. 1 shows the inhibitor 4 forming a discrete layer on the surface of the print medium 2, the inhibitor 4 may penetrate into the print medium 2.

The inhibitor 4 may be incorporated into the print medium 2 by any techniques known in the art, such as by a hot melt application. The inhibitor 4 may be heated to a temperature above its melting point and applied to the surface of the print medium 2 to form a coating or film. The inhibitor 4 may be heated using a heat source that is capable of heating the inhibitor 4 to a temperature above its melting point. The heat source may be included as a component of a conventional inkjet printer used to print the image. Alternatively, the heat source may be present in a separate device, such as in a conventional lamination device. It is also contemplated that a hot iron may be used to heat the inhibitor 4.

The melted inhibitor 4 may be applied to the print medium 2 using an inkjet pen in the inkjet printer. Inkjet pens are known in the art and, as such, are not described in detail herein. The inhibitor 4 may also be applied to the print medium 2 using a conventional coating technique, such as roll coating, air knife coating, blade coating, bar coating, gravure coating, rod coating, curtain coating, die coating, or air brush coating. The inhibitor 4 may be applied to the print medium 2 as an overcoating, after the image is printed, or as an undercoating, before the image is printed.

The inhibitor 4 may also be incorporated into the print medium 2 by solubilizing the inhibitor 4 in an appropriate solvent. The solution of the inhibitor 4 may be applied to the print medium 2, such as by spraying the solution onto the print medium 2 or by soaking the print medium 2 in the solution. The inhibitor 4 may also be incorporated into the print medium 2 as an additive. Alternatively, the inhibitor 4 may be incorporated into a slurry used to form the print medium 2, such as before the calendaring process.

If the inhibitor 4 is a high molecular weight polymer, a high, localized concentration of the functional groups may be present on the surface of the print medium 2 because the polymer may not readily absorb into the print medium 2. Instead, the polymer may remain on the surface of the print medium 2. Therefore, the functional groups providing the reactivity to the inhibitor 4 may be readily available on the surface of the print medium 2 to react with the atmospheric pollutant. Since the functional groups of the inhibitor 4 are present at high concentrations, the protection against gasfade may be long-lasting. In one desirable embodiment, the inhibitor is a high molecular weight polymer having a molecular weight over 1000. The high molecular weight polymer has numerous functional groups that are capable of reacting with the atmospheric pollutant and, therefore, provides long term protection against gasfade. In contrast, where a water-soluble, sulfur-containing polymer or thiol or sulfide compound having a lower molecular weight is used as the inhibitor, the compound is more readily adsorbed into the print medium 2 when the inkjet ink is applied. While lower molecular weight compounds may be used as the inhibitor, these compounds may provide shorter-lasting protection compared to the inhibitors having high molecular weight polymers.

Figure 2:
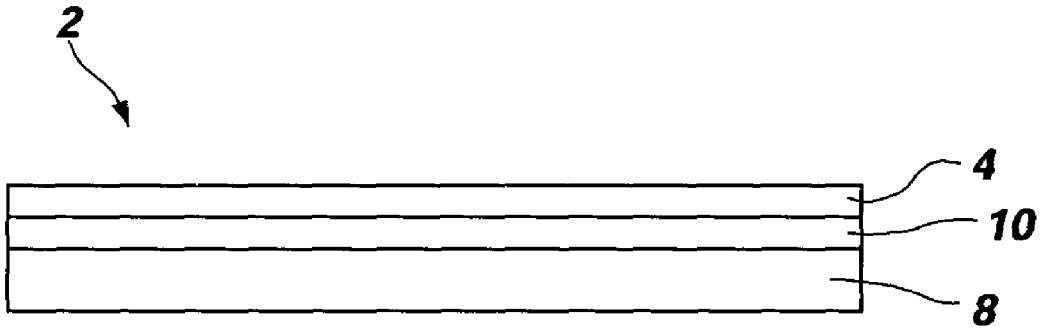

As previously mentioned, the print medium 2 to which the inhibitor 4 is applied may be a conventional print medium, such as a plain paper 6 or a specialized photographic medium. The plain paper 6 may include, but is not limited to, a copier paper having from approximately 25% to approximately 100% cotton fibers. Plain papers and techniques for fabricating plain papers are known in the art and, as such, are not described in detail herein. If the print medium 2 is a specialized photographic medium, the print medium 2 may include a substrate layer 8 and an ink-receiving layer 10, as shown in FIG. 2. Materials for the substrate layer 8 are known in the art and may include a paperbase or a photobase. For instance, the substrate layer 8 may include a hard or flexible material made from a polymer, a paper, a glass, a ceramic, a woven cloth, or a non-woven cloth material. The ink-receiving layer 10 may be coated on the substrate layer 8 as known in the art and may include inorganic or organic materials, such as inorganic particles or organic polymers. The specialized photographic medium may be a porous print medium or a swellable print medium, both of which are known in the art. For sake of example only, the porous print medium may include diatomaceous earth, zeolitic materials, alumina, silica, or combinations thereof in the ink-receiving layer 10.

In one embodiment, the inhibitor 4 is poly(phenylene sulfide) ("PPS"). Unlike many carbon compounds that include sulfur, PPS is odorless and, therefore, is advantageously used in the present invention. PPS is a polymer formed from monomers having the following structure:

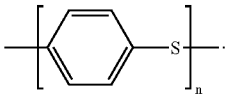

The molecular weight of the PPS is at least approximately 1000 so that a sufficient number of sulfide functional groups are present to react with the atmospheric pollutant and provide long term protection. In one embodiment, the PPS has a molecular weight of at least 10000. While the structure above shows poly(1,4-phenylene sulfide), poly(1,3-phenylene sulfide) or mixtures of poly(1,4-phenylene sulfide) and poly(1,3-phenylene sulfide) may also be used as the inhibitor. PPS may be prepared by conventional techniques or may be purchased from a chemical supplier, such as Sigma-Aldrich Co. (St. Louis, Mo.). PPS is commercially available in a variety of molecular weights depending on the number of polymerized monomers that are present. PPS has a melting point ranging from approximately 285° C. to approximately 300° C. and a $T_g$ of approximately 150° C. In addition, PPS is insoluble in common solvents at temperatures below approximately 200° C. Since PPS has a high melting point, $T_g$, and is relatively insoluble, PPS is incorporated into the print medium 2 by heating the PPS to a temperature above approximately 285° C. and coating the PPS on the print medium 2.

The print medium 2 having the printed image may contact at least one atmospheric pollutant, such as $O_3$ or $NO_x$. The printed image may be applied to the print medium 2 by a conventional printing technique including, but not limited to, inkjet printing using a conventional inkjet printer. As previously mentioned, the image may be printed with a dye-based or a pigment-based inkjet ink. The print medium 2 may be exposed to air that includes the atmospheric pollutant. Since the atmospheric pollutant is more reactive with the inhibitor than it is with the colorant, the atmospheric pollutant may bind to the inhibitor, which prevents the atmospheric pollutant from reacting with and degrading the colorant.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A print medium having increased resistance to gasfade, comprising:

a melt-coated, discrete, topmost inhibitor layer on at least one surface of the print medium, the layer including at least one odorless sulfur-containing polymer, wherein the at least one polymer has a molecular weight greater than approximately 1000, wherein the at least one polymer is selected from the group consisting of poly(1,4-phenylene sulfide), poly(1,3-phenylene sulfide), and combinations thereof, and wherein the print medium comprises a plain paper, a porous print medium, or a swellable print medium.

2. A print medium having increased resistance to gasfade, comprising:

a melt-coated discrete inhibitor layer on at least one surface of the print medium, the layer including at least one poly(phenylene sulfide), wherein the at least one poly (phenylene sulfide) has a molecular weight greater than approximately 1000, and wherein the at least one poly (phenylene sulfide) is present at a concentration from approximately 0.25% by weight per $cm^2$ of the print medium to approximately 30% by weight per $cm^2$ of the print medium.

3. A method of forming a print medium having increased resistance to gasfade, comprising:

providing a medium comprising a plain paper, a porous medium, or a swellable medium;

melting an ozone inhibitor selected from at least one odorless sulfur-containing polymer, wherein the polymer has a molecular weight greater than approximately 1000, and wherein the polymer is selected from the group consisting of poly(1,4-phenylene sulfide), poly(1,3-phenylene sulfide), and combinations thereof; and applying the melted inhibitor as a topmost, discrete layer on at least one surface of the medium, thereby forming the print medium having increased resistance to gasfade.

4. The method of claim 3, wherein melting the ozone inhibitor comprises heating the inhibitor to a temperature above its melting point.

5. The method of claim 3, wherein the ozone inhibitor is present in a concentration from approximately 0.25% by weight per $cm^2$ of the print medium.

6. The method of claim 3, wherein the ozone inhibitor has a melting point ranging from approximately 125° C. to approximately 400° C. and a glass transition temperature ranging from approximately 75° C. to approximately 250° C.

7. A method of producing a printed image having increased resistance to gasfade, comprising:

depositing inkjet ink onto a medium, the medium comprising a plain paper, a porous medium, or a swellable medium;

melting an ozone inhibitor selected from at least one odorless sulfur-containing polymer, wherein the polymer has a molecular weight greater than approximately 1000, and wherein the polymer is selected from the group consisting of poly(1,4-phenylene sulfide), poly(1,3-phenylene sulfide, and combinations thereof; and applying the melted inhibitor as a topmost, discrete inhibitor layer onto at least one surface of the medium, thereby producing the printed image haying increased resistance to gasfade.

8. The method of claim 7, wherein the inkjet ink is a dye-based or a pigment-based inkjet ink.

9. A print medium having increased resistance to gasfade, comprising:

a melt-coated, topmost, discrete inhibitor layer on at least one surface of the print medium, including at least one odorless poly(phenylene sulfide);

wherein the at least one poly(phenylene sulfide) has a melting point ranging from approximately 125° C. to approximately 400° C. and a glass transition temperature ranging from approximately 75° C. to approximately 250° C., and wherein the print medium comprises a plain paper, a porous print medium, or a swellable print medium.

10. The print medium of claim 9, wherein the at least one odorless poly(phenylene sulfide) is selected from the group consisting of poly(1,4-phenylene sulfide), poly(1,3-phenylene sulfide), and combinations thereof.

11. The print medium of claim 9, wherein the at least one odorless poly(phenylene sulfide) is present in a concentration from approximately 0.25% by weight per $cm^2$ of the print medium to approximately 30% by weight per $cm^2$ of the print medium.

12. The print medium of claim 9, wherein the at least one odorless poly(phenylene sulfide) has a molecular weight greater than approximately 1000.

13. A print medium having increased resistance to gasfade, comprising:

a melt-coated topmost, discrete, inhibitor layer on at least one surface of the print medium, the layer including an at least one odorless sulfur-containing polymer;

wherein the at least one polymer is present in a concentration from approximately 0.25% by weight per $cm^2$ of the print medium to approximately 30% by weight per $cm^2$ of the print medium; wherein the at least one polymer is selected from the group consisting of poly(1,4-phenylene sulfide), poly(1,3-phenylene sulfide), and combinations thereof; and wherein the print medium comprises a plain paper, a porous print medium, or a swellable print medium.

14. The print medium of claim 13, wherein the at least one polymer has a melting point ranging from approximately 125° C. to approximately 400° C. and a glass transition temperature ranging from approximately 75° C. to approximately 250° C.

15. The print medium of claim 13, wherein the at least one polymer has a molecular weight greater than approximately 1000.

16. A print medium having increased resistance to gasfade, comprising:

a melt-coated topmost, discrete inhibitor layer on at least one surface of the print medium, the layer including at least one odorless sulfur-containing polymer, the at least one polymer being selected from the group consisting of poly(1,4-phenylene sulfide), poly(1,3-phenylene sulfide), and combinations thereof.

* * * * *